US006719438B2

(12) United States Patent
Sevack et al.

(10) Patent No.: US 6,719,438 B2
(45) Date of Patent: Apr. 13, 2004

(54) SPRING FOR SECURING TRIMS IN RECESSED LIGHTING HOUSINGS

(75) Inventors: Lloyd Sevack, Montreal (CA); Mario Viscusi, Vimont Laval (CA)

(73) Assignee: Tripar Inc., Montreal (CA)

( * ) Notice: Subject to any disclaimer, the term of this patent is extended or adjusted under 35 U.S.C. 154(b) by 0 days.

(21) Appl. No.: 10/434,018

(22) Filed: May 8, 2003

(65) Prior Publication Data

US 2003/0210551 A1 Nov. 13, 2003

Related U.S. Application Data

(60) Provisional application No. 60/378,726, filed on May 9, 2002.

(51) Int. Cl.[7] ..... F21V 17/00
(52) U.S. Cl. ..... 362/147; 362/145
(58) Field of Search ..... 362/147, 148, 362/150, 145

(56) References Cited

U.S. PATENT DOCUMENTS 5,957,572 A * 9/1999 Wedekind et al. ..... 362/365
6,030,102 A * 2/2000 Gromotka ..... 362/365
6,375,338 B1 * 4/2002 Cummings et al. ..... 362/276

* cited by examiner

*Primary Examiner*—Laura K. Tso
(74) *Attorney, Agent, or Firm*—Alfred M. Walker

(57) ABSTRACT

A trim assembly is mounted by a resilient spring in a housing, which is recessed in a ceiling, to support a light fixture. The trim assembly includes a cylindrical collar insertable within the housing and a flange with a central opening supporting one end of the cylindrical collar surrounding the opening being flush with the ceiling, when the trim assembly is mounted within the housing. A gimbal, which is located within and spaced apart from the collar, supports the light fixture. The springs are attached to opposite sides of an outer surface of the collar, for engaging an inner surface of the housing, to hold the trim assembly in place. In addition, the gimbal is retained within the collar by fasteners which allow limited rotation of the gimbal.

38 Claims, 5 Drawing Sheets

SPRING FOR SECURING TRIMS IN RECESSED LIGHTING HOUSINGS

RELATED APPLICATIONS

This application claims benefit under 35 USC 119 (e) of provisional patent application Ser. No. 60/378,726, filed May 9, 2002.

FIELD OF THE INVENTION

The present invention relates to a spring providing a friction fit connection of a recessed lighting trim and lamp accommodating gimbal assembly to a substantially curved inner surface of a hollow lighting housing can.

BACKGROUND

For recessed lighting fixtures, trims are used to hold gimbals (or "eyeballs"), which in turn retain the light bulb or socket. Trims, finished in any number of finishes, also serve as the decorative elements that contact the ceiling, leaving nothing other than the trim, gimbal and bulb visible.

The gimbals are typically riveted to the trims at two opposing peripheral points, allowing the gimbal to pivot to direct the light beam. Trims usually snap into the recessed housings in one of two ways. The first has the housing containing three springs, with the trim having a groove that allows the springs to mechanically bind the trim. The second has the trim containing two or three springs, with the housing either having a groove or not.

A significant problem that occurs with the latter when the housing has no groove, is that the trim assembly is held in place by nothing other than friction, leaving the assembly free to gradually drop from vibration, until it finally falls free, dangling from nothing other than two wires.

Additional problems with existing approaches include:

Laborious work involved in mechanically affixing three springs to the housing or trim.

The face of the housing should be flush with the surrounding ceiling, but if the housing is installed slightly offset or canted, the engagement of the grooves with the springs prevents any adjustment.

Up to five rivets are required; two or three for the springs, and two for the gimbal.

OBJECTS OF THE INVENTION

It is therefore an object of the present invention to provide a retaining spring for connecting a trim and gimbal assembly of a recessed lighting fixture to a curved inner surface of a lighting housing can.

It is also an object of the present invention to provide a high friction or mechanically binding fit retainer permitting a lamp accommodating gimbal to pivot in place within a recessed lighting fixture.

It is also an object of the present invention to provide a retainer spring system that permits the trim to be secured flush with the ceiling irrespective of a slightly canted or otherwise improperly installed housing.

SUMMARY OF THE INVENTION

The present invention eliminates these problems and offers a number of other advantages.

The proposed trim assembly makes use of two slightly curved "flat" springs. The trims contain an extruded centerhole, with two formed and cross-drilled holes. Either painting or plating according to the manufacturer's wishes may finish the trims and gimbals. Once the finish has been applied, the lamp accommodating gimbal is placed inside the centerhole, and two curved springs placed on the outside; one on each side of the extruded hole. This assembly is secured together with only two rivets.

The springs contain a number of beneficial features to solve application specific problems, such as:

a) Dual purpose: They are curved so that when mounted with the concave face outward, they allow small trims to fit in large housings. When mounted with the convex face outward, correct clearances to fit the same or larger trims in small housings are achieved.

b) High friction retention: When mounted with the convex face outward, outwardly projecting teeth bite into the inside surface of the housing, providing increased resistance to unwanted slippage, such as may otherwise occur from vibration on the floor above where the recessed fixture is installed. When mounted with the concave face outward, similar properties are achieved by way of sharp corners biting into the inside surface of the housing.

c) Variable position retention: Because there is no distinct mechanical engagement feature between the trim and housing, the trim may be inserted until the inner face contacts the ceiling, where it will remain due to the spring's teeth or corners binding at any position within the housing. A secondary but equally important advantage from this is that it allows the face of the trim holder to be pressed flush with the surrounding ceiling, even if the housing is installed slightly offset or canted.

d) Easy insertion: The top edges of the springs contain arced shapes, permitting the springs to be self-compressed as the trim assembly is pushed into the housing.

e) Positive spring location: The bottom edge of the spring is conventionally notched, so that it clears any radii present where the face trim and extruded hole surfaces meet. This ensures that the unnotched outer areas of the spring remain in intimate contact with the inside face of the rim, preventing any rotational movement of the spring.

f) Ease of assembly: The same two rivets that are required to secure the gimbal to the trim are used to secure the springs to the trim.

g) Grace from falling: Should extreme vibration cause the trim to slip downward, because the upper corners of the spring extend approximately ⅜" from the inside face of the trim, the trim will not fall free until or unless it has gradually slipped at least ⅜". This is highly unlikely since the user is likely to spot lesser separation from the ceiling, at which point the trim can simply be pushed back tight to the ceiling.

In keeping with the foregoing objects and beneficial features, the present invention is a spring for securing trims and lamp accommodating gimbals in recessed lighting housings.

One embodiment includes a pair of springs concavely mounted (curving outward) to a 5 inch trim, so that the trim fits properly in a housing, such as a 4³⁄₁₆ inch diameter can. Within the trim is a gimbal that is suitable for accepting a halogen light bulb.

Another embodiment includes a pair of springs which are convexly mounted (curving inward) to a 4⅜ inch trim, so that the trim fits properly in a smaller housing, such as a 4 inch diameter can. Within the trim is a gimbal, which is suitable for accepting smaller sized halogen light bulbs. Because of their constant outside diameter, the gimbals can easily be mounted in the opposite trims.

A further embodiment contains a pair of springs which are convexly mounted (curving inward) to a 5 inch trim, so that the trim fits properly within the housing, such as a 4 3/16 inch diameter can. The three tabs on the side of the trim capture the wide end of the lamp reflector, and the narrow neck holds the small gimbal, which is suitable for accepting either of the small halogen light bulbs.

The foregoing dimensions are illustrative only.

Depending how these curved springs are mounted to the trim (curved in or out), they secure a variety of trim assemblies to fit in an equally wide variety of housing sizes. The top edges of the springs have gentle curves, permitting the springs to be self-compressed as the trim is pushed into the housing. Unintentional removal however is not so easy. Mounted with the curve facing inward, projecting teeth bite into the inside surface of the housing, providing excellent resistance to movement from vibration. When mounted with the curve facing outward, similar retention is achieved by way of sharp corners biting into the inside surface of the housing.

Assembling these springs is incidental, as the same two rivets used to secure the gimbal to the inside of the trim are used to secure the springs to the outside.

Flush installation of housings to the ceiling is no longer critical. Because the spring ends bind at any position within the housing, the trim can always be pushed flush to the ceiling, even if the housing is installed slightly recessed or even canted.

The springs are compatible with a wide variety of trims and housings, offering solutions to almost any lighting application.

The trim assembly of the present invention is mounted in a housing which is recessed in a ceiling, to support a light fixture. The trim assembly includes a trim with a cylindrical collar adapted to be inserted into the housing. The trim also includes a flange. A central opening extends within one end of the cylindrical collar of the trim, which surrounds the opening. The trim flange is adapted to being flush with the ceiling, when the trim assembly is mounted within the housing. A gimbal, which is located and pivotable within the collar, supports the light fixture. The preferably pair of springs are attached to opposite sides of an outer surface of the collar, for engaging an inner surface of the housing, to hold the trim assembly in place. In addition, the gimbal is retained within the collar and loosely attached by oppositely located rivets extending through the collar. These rivets allow limited pivotable rotation of the gimbal about the pair of rivets.

The springs engage the inner surface of the recessed lighting fixture housing can by friction, for easy removal and adjustment of the trim assembly within the housing. These springs are elongated, with opposite ends, which make the engagement with the inner surface of the housing.

Each rivet of the pair of rivets permitting rotation of the gimbal within the collar of the trim is attached at one end of the rivet to each spring of the pair of springs, wherein the rivet passes through the collar and has another end terminating in a respective hole within the wall of the gimbal and allows the rotation of the gimbal about the pair of rivets.

Depending upon the size of the trim to be fit within a housing, the springs are either flexed concavely or convexly. Each spring is curved with a concave side facing the inner surface of the housing, to allow small trims to fit large housings. Mounted in this orientation, these springs have sharp ends that contact and slightly embed within the inner surface of the large housing.

Likewise, to fit larger trims within small housings, each spring is curved with a convex side facing the inner surface of the housing. Mounted in this orientation, these springs also have bent tab ends that contact and slightly embed within the inner surface of the housing.

Preferably, these springs have rounded top corners, which allow easy insertion of the collar into the housing. The springs also have legs which extend toward, and contact with an upper surface of the flange, to avoid any radius at a junction of the collar and flange.

The ends of the springs are spaced apart from the flange, to provide a fail/safe distance of engagement, in the event the trim assembly were to fall slightly due to shock or vibration.

For conical shaped reflectors, the trim assembly mounts in a housing which is recessed in a ceiling, to support a light fixture. The trim assembly includes a cylindrical collar adapted to be inserted into the housing and a flange with a central opening supporting one end of the collar surrounding the opening, which is adapted to being flush with the ceiling when the trim assembly is mounted within the housing. The conical reflector is mounted within the collar with a narrow, open end of the reflector being located above the flange. A gimbal is mounted within the narrow end of the reflector to support a light bulb. These springs are attached to opposite sides of an outer surface of the collar, to engage an inner surface of the housing, to hold the trim assembly in place.

BRIEF DESCRIPTION OF THE DRAWINGS

In describing the preferred embodiment, reference is made to the accompanying drawings wherein like parts have like reference numerals, and wherein.

DETAILED DESCRIPTION OF THE INVENTION

Figure 1:
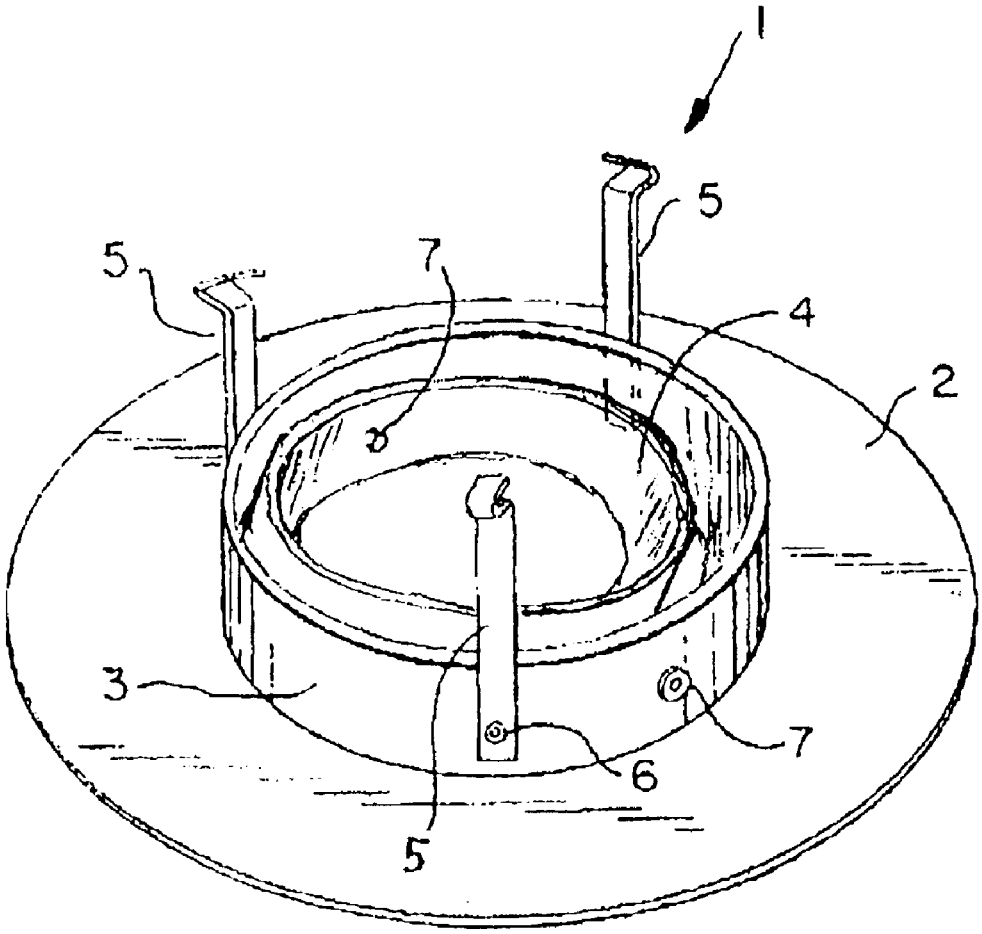
FIG. 1 (PRIOR ART)
FIG. 1 is a perspective view of a prior art trim assembly, using three friction springs with a total of five rivets.

FIG. 1 shows one type of popular prior art trim assembly 1 with trim flange 2, trim collar 3, and typically annular gimbal 4. In this trim assembly, three shaped leaf springs 5 are used to secure trim assembly 1 to the inside of a can or housing by friction. Three rivets 6 are typically required to attach springs 5 to collar 3, with an additional two rivets 7 to attach gimbal 4.

Figure 2:
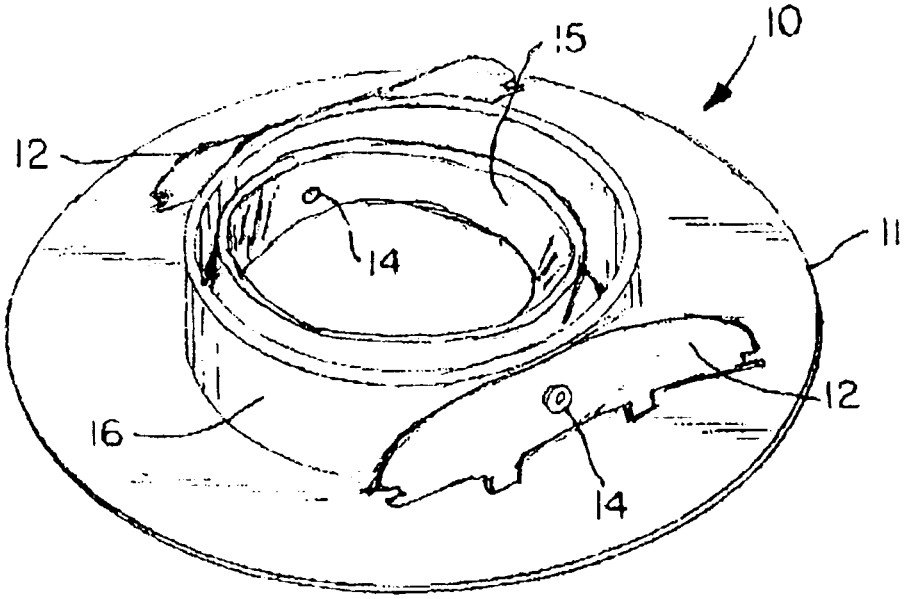
FIG. 2 is a perspective view of a trim assembly with securing springs of this invention shown mounted concavely outward.

FIG. 2 shows trim assembly 10 with flanged trim 11 with collar 16 extending upward therefrom. Two securing springs 12 of this invention are attached at opposite sides of upward extending collar 16 by fasteners 14, such as rivets 14, extending through collar 16 and thence through typically annular gimbal (or "eyeball") 15.

In this assembly of FIG. 2, securing springs 12 are mounted concavely outward by fastener rivets 14. These fastener rivets 14 extend through upward extending collar 16 and through rotatable gimbal 15, which accommodates a lamp therein. For example, trim 11 could be a five-inch trim, and gimbal 15 could be sized to accept a PAR 20 type halogen bulb. Assembly 10 can fit properly in a 4 3/16 inch diameter can.

Oppositely positioned fastener rivets 14 are in positional register with each other through an imaginary line extending from one fastener rivet 14 to the oppositely positioned rivet fastener 14. In that manner, lamp accommodating gimbal 15 pivots about the pair of fastener rivets 14, to change the direction of light emanating from the lamp located within gimbal 15.

Figure 3:
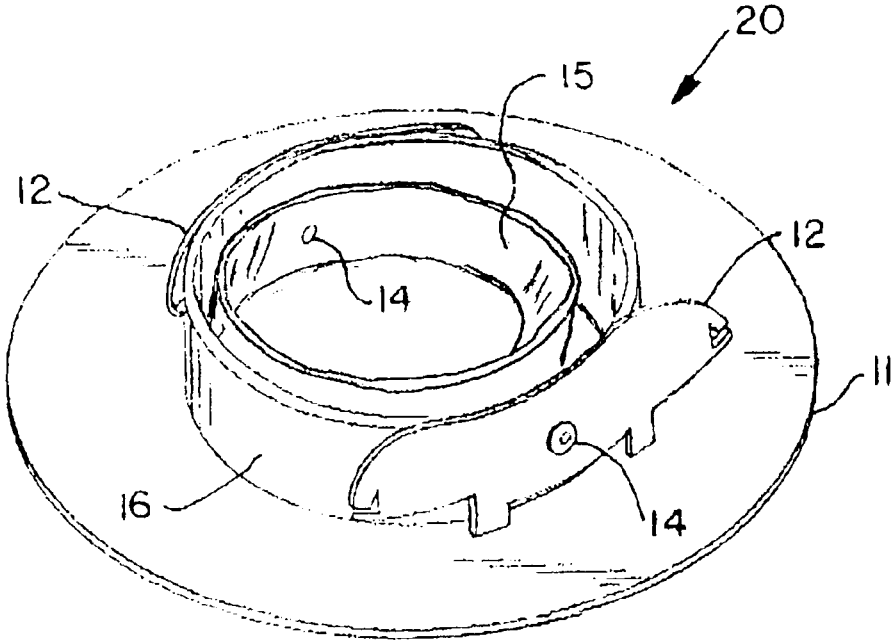
FIG. 3 is a perspective view of a trim assembly with securing springs of this invention, shown mounted convexly outward.

FIG. 3 shows trim assembly 20 using securing springs 12 mounted convexly outward. For example, trim 11 in assembly 20 can be a flange of about 4 3/8" and would fit into a 4" can accommodating a smaller MR16 or GU10 sized halogen lamp.

Figure 4:
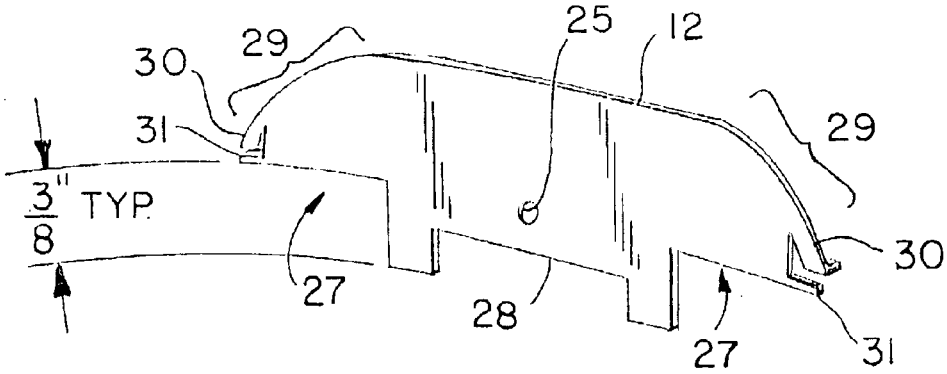
FIG. 4 is a perspective view of the securing spring of this invention showing details of the contour.
Figure 5:
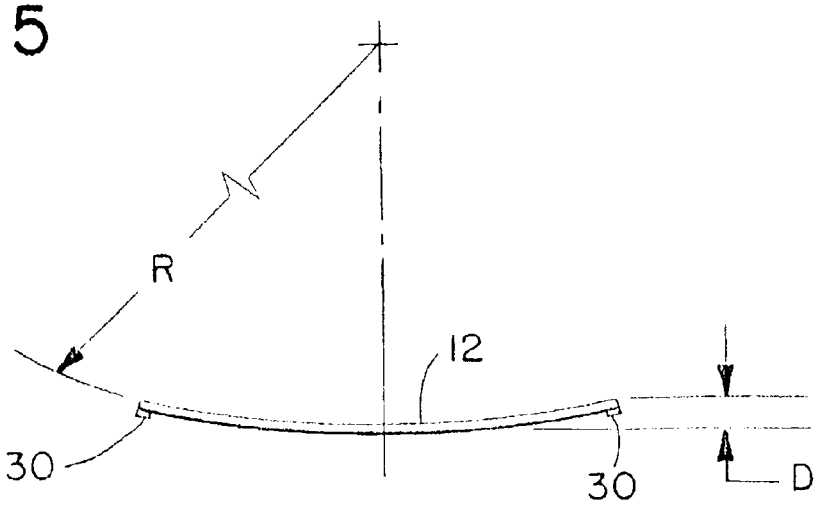
FIG. 5 is an edge view of the securing spring showing curvature.

FIGS. 4 and 5 show details of spring 12. Spring 12 is curved, with a predetermined radius R. While other radii may be applicable, in FIG. 5 a typical radius of about seven inches is shown as an example. The edge of spring 12 is spaced apart by a dimension D from a tangent line off of the arc of curvature of spring 12. While other dimensions may be applicable, in FIG. 5 dimension D is shown to be about 0.148 inches as an example. The slight curvature that makes springs 12 so versatile as to accommodate a variety of trim and can sizes is shown in FIG. 5. Rounded top corners 29 accommodate easy insertion into cans (or housings), as they allow the springs to be progressively compressed (bent), as the collar 16 of trim assembly 20 is urged into the opening of the can. Hole 25 accommodates a rivet that may also be used to attach a gimbal or "eyeball". Sharp ends 31 will contact and slightly embed into a housing or can when springs 12 are mounted concave outward. Similarly, bent tabs 30 will contact the inner surface of a can when springs 12 are mounted convex outward. Central recess 28 allows springs 12 to avoid any radius or ridge that might be at the juncture of a trim 11 and collar 16 of a trim to permit better fit. Clearance areas 27 place engaging ends 30 and 31 about 3/8" above the bottom of a can so as to provide a fail/safe distance of engagement if a trim assembly were to fall slightly due to shock or vibration. This distance should be enough to provide a visual cue that some movement has occurred; the trim assembly can then be pushed up again so that flange 11 is flush with the ceiling surface.

Figure 6:
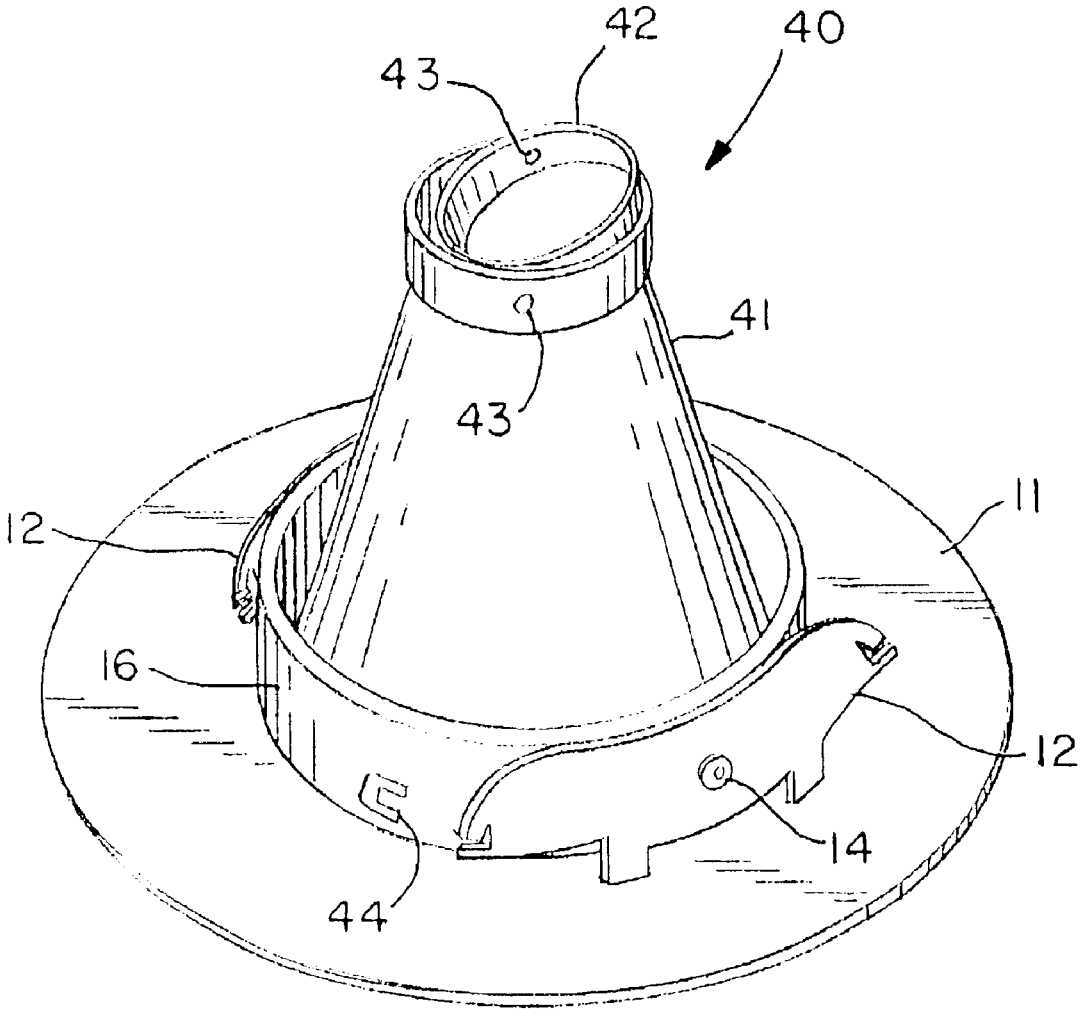
FIG. 6 is a perspective view of the trim assembly of this invention used with a conical reflector; and, FIG. 7 is a side view of a typical installation of recessed lighting using trim security springs of this invention, showing a housing can in crossection.

FIG. 6 shows that securing springs 12 can also be used in trim assemblies 40 which include a conical reflector 41. Conical reflector 41 has a flange at its wide end that is captured by three tabs 44 which are bent inward; tabs 44 are part of collar 16. The narrow end of reflector 41 holds small gimbal 42 which is attached via rivets 43. In this application, rivets 14 are not dual purpose; they are used just to attach springs 12 to collar 16.

Figure 7:
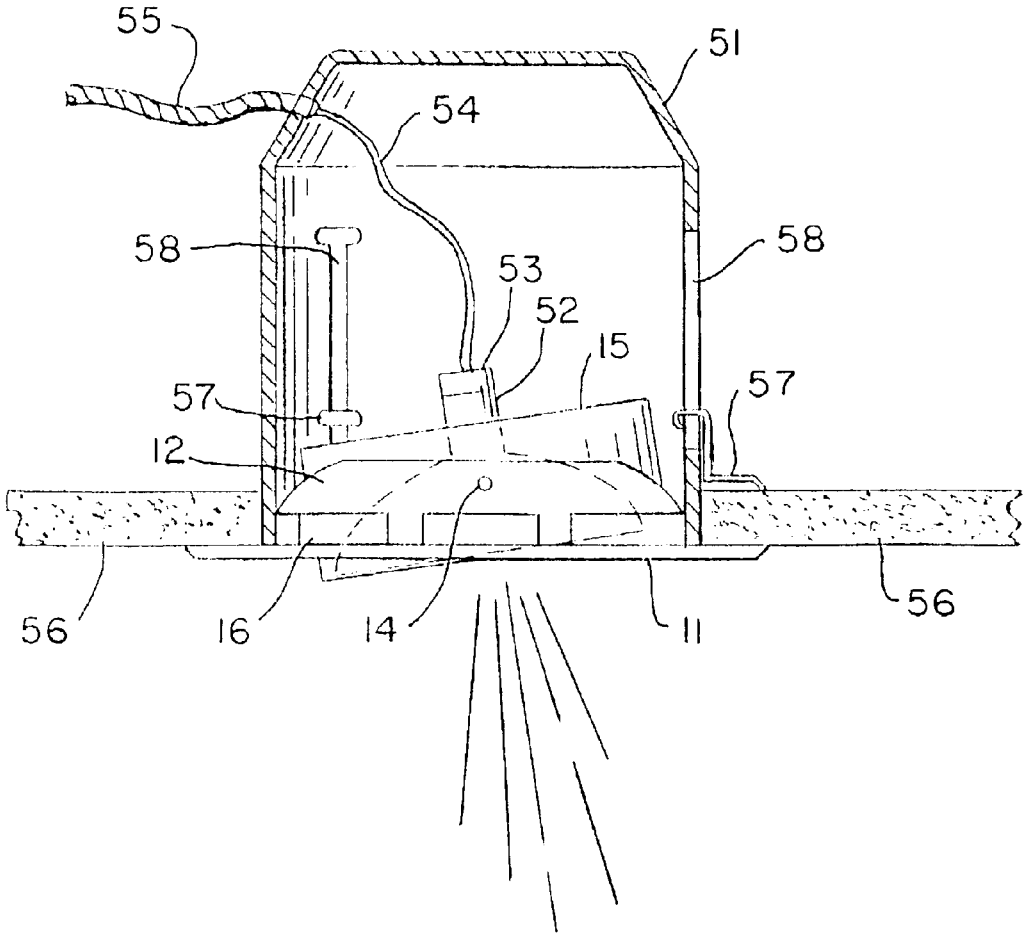

FIG. 7 is an illustration of a typical installation 50 incorporating the trim securing springs of this invention. Housing can 51 is shown in crossection for clarity. Trim ring 11 is shown flush against ceiling 56. Housing can 51 is secured to the ceiling 56 by one or more conventional L-shaped retaining clips 57 having a horizontal portion and a vertical portion extending therefrom, wherein a distal end of the vertical portion has a curved bent end engagable within a T-shaped slot 58 within a wall of housing can 51. Foreground trim spring 12 is shown within housing can 51 attached to trim collar 16 via rivet 14. Rivet 14 also attaches gimbal 15 which is adjusted (as shown) in a slight tilt. Halogen lamp 52 is retained within gimbal 15; it is powered via socket 53, high temperature insulated pigtail 54 and armored cable 55. This figure has been presented to show the relationship of trim spring 12 within the context of a more complete recessed lighting installation. Many installation 50 variations are possible while still using trim securing springs 12.

While the preferred embodiment uses the oppositely positioned pair of springs 12, it is anticipated that in an alternate embodiment, a single spring 12 could be used, wherein gimbal still pivots about the pair of fastener rivets 14, with one of the fastener rivets attaching both spring 12 and gimbal 15 to collar 16, and the other oppositely positioned fastener rivet 14 only holding the opposite side of gimbal 15 to collar 16, whereby the pair of fastener rivets 14 allow limited rotation of gimbal 15 within collar 16.

The above detailed description of this invention has been given for ease of understanding only. No unnecessary limitations should be understood therefrom, as modifications will be obvious to one skilled in the art.

Similar reference characters denote corresponding features consistently throughout the attached drawings. It is to be understood that the present invention is not limited to the sole embodiment described above, but encompasses any and all embodiments within the scope of the stated claims.

We claim:

1. A trim assembly for mounting in a housing recessed in a ceiling to support a light fixture comprising:

a cylindrical collar adapted to be inserted into said housing;

a flange with a central opening supporting one end of said collar surrounding said opening adapted to being flush with said ceiling when said trim assembly is mounted within said housing;

a gimbal within and spaced from said collar for supporting said light fixture;

a pair of curved springs mounted at opposite sides of an outer surface of said collar;

said springs being curved to be either flexed concavely or convexly;

attachment means for attaching said springs to said opposite sides of said outer surface of said collar for engaging an inner surface of said housing to hold said trim assembly in place; and, said attaching means also retaining said gimbal within said collar and allowing limited rotation of said gimbal.

2. The trim assembly of claim 1 in which said springs engage said inner surface by friction for easy removal and adjustment of said trim assembly within said housing.

3. The trim assembly of claim 1 in which said springs are elongated with opposite ends which make the engagement with said inner surface of said housing.

4. The trim assembly of claim 1 in which said attaching means includes a rivet attached at one end to each of said springs, said rivet passing through said collar and having another end terminating in said gimbal and allowing said rotation of said gimbal.

5. The trim assembly of claim 1 in which each said spring is curved with a concave side facing said inner surface of said housing.

6. The trim assembly of claim 1 in which each said spring has sharp ends for contacting and slightly embedding with the inner surface of said housing.

7. The trim assembly of claim 1 in which each said spring is curved with a convex side facing said inner surface of said housing.

8. The trim assembly of claim 1 in which each said spring has a bent tab for making said contact with the inner surface of said housing.

9. The trim assembly of claim 1 in which said springs have rounded top corners for allowing easy insertion of said collar into said housing.

10. The trim assembly of claim 1 in which said springs have legs which extend toward and contact an upper surface of said flange to avoid any radius at a junction of said collar and flange.

11. The trim assembly of claim 1 in which the ends of said springs are spaced from said flange to provide a fail/safe distance of engagement in the event said trim assembly were to fall slightly due to shock or vibration.

12. A trim assembly for mounting in a housing recessed in a ceiling to support a light fixture comprising:

a cylindrical collar adapted to be inserted into said housing;

a flange with a central opening supporting one end of said collar surrounding said opening adapted to being flush with said ceiling when said trim assembly is mounted within said housing;

a conical reflector mounted within said collar with a narrow, open end of said reflector being located above said flange;

a pair of springs mounted at opposite sides of an outer surface of said collar;

said springs being curved to be either flexed concavely or convexly;

a gimbal mounted within the narrow end of said reflector for supporting a light fixture; and, attachment means for attaching said springs to opposite sides of an outer surface of said collar for engaging an inner surface of said housing to hold said trim assembly in place.

13. A spring for providing resilient friction fit against a substantially curved surface of a hollow recess of a recessed lighting housing can, comprising:

a one-piece curved spring including a pair of opposite arc-shaped wing tips interconnected with a central body part joining said pair of opposite arc-shaped wing tips, said arc-shaped wing tips being spaced from one another;

said one-piece curved spring being connected by a fastener to an upwardly extending collar of a flanged trim of the recessed lighting housing can;

said spring being curved to be either flexed concavely or convexly;

said arc-shaped wing tips having distal bent tab portions contacting a concave inner surface of a housing;

said distal bent tab portions conforming to and contacting said concave inner surfaces over an arcuate area and serving as a positive stop against said concave inner surface of said housing; and, said central body part having a lower central recess accommodating a protrusion at a juncture between a gimbal connected to a trim flange.

14. The spring as defined in claim 13, wherein each of said arc-shaped wing tips curves extends convexly outward in a substantially circular arc.

15. The spring as defined in claim 13, wherein each of said arc-shaped wing tips curves extends concavely outward in a substantially circular arc.

16. The spring as in claim 13, wherein said curved arc-shaped wing tips are so curved that when said distal bent tab portions of said wing tips are contact against said substantially curved surface they serve as a positive stop against said concave surface.

17. The spring as in claim 13 further comprising at least one through-hole substantially centered in the central section between said distal outer wing tips, wherein said through-hole is suitable to allow passage of a mechanical fastener for securing said spring to a member being held in a friction fit with said concave surface.

18. The spring as in claim 13, wherein a top portion of said spring curves downward to each respective distal end, ending in said respective bent tabs.

19. The spring as in claim 18 wherein said spring is mounted to said collar of said flanged trim opposite to a further spring also mounted to said collar.

20. A trim assembly for mounting in a housing recessed in a ceiling to support a light fixture comprising:

a trim having a collar adapted to be inserted into said housing;

a gimbal within and spaced from said collar for supporting said light fixture;

a plurality of curved springs mounted at an outer surface of said trim;

said springs being curved to be either flexed concavely or convexly;

said springs engaging an inner surface of said housing to hold said trim assembly in place; and, said gimbal movable within said collar and allowing limited rotation of said gimbal.

21. The trim assembly of claim 20 in which said springs engage said inner surface by friction for easy removal and adjustment of said trim assembly within said housing.

22. The trim assembly of claim 21 in which said springs are elongated with opposite ends which make the engagement with said inner surface of said housing.

23. The trim assembly of claim 20 in which said attaching means includes a rivet attached at one end to each of said springs, said rivet passing through said collar and having another end terminating in said gimbal and allowing said rotation of said gimbal.

24. The trim assembly of claim 20 in which each said spring is curved with a concave side facing said inner surface of said housing.

25. The trim assembly of claim 20 in which each said spring has sharp ends for contacting and slightly embedding with the inner surface of said housing.

26. The trim assembly of claim 20 in which each said spring is curved with a convex side facing said inner surface of said housing.

27. The trim assembly of claim 20 in which each said spring has a bent tab for making said contact with the inner surface of said housing.

28. The trim assembly of claim 20 in which said springs have rounded top corners for allowing easy insertion of said collar into said housing.

29. The trim assembly of claim 20 in which said springs have legs which extend toward and contact an upper surface of said flange to avoid any radius at a junction of said collar and flange.

30. The trim assembly of claim 20 in which the ends of said springs are spaced from said flange to provide a fail/safe distance of engagement in the event said trim assembly were to fall slightly due to shock or vibration.

31. A trim assembly for mounting in a housing recessed in a ceiling to support a light fixture comprising:

a cylindrical collar adapted to be inserted into said housing;

a flange with a central opening supporting one end of said collar surrounding said opening adapted to being flush with said ceiling when said trim assembly is mounted within said housing;

a conical reflector mounted within said collar with a narrow, open end of said reflector being located above said flange;

a pair of springs mounted at opposite sides of an outer surface of said collar;

said springs being curved to be either flexed concavely or convexly;

a gimbal mounted within the narrow end of said reflector for supporting a light fixture; and, attachment means for attaching said springs to opposite sides of an outer surface of said collar for engaging an inner surface of said housing to hold said trim assembly in place.

32. A spring for providing resilient friction fit against a substantially curved surface of a hollow recess of a recessed lighting housing can, comprising:

a one-piece curved spring including a pair of opposite wing tips interconnected with a central body part joining said pair of opposite wing tips, said wing tips being spaced from one another;

said one-piece curved spring being connected by a fastener to a trim insertable within the recessed lighting housing can;

said spring being curved to be either flexed concavely or convexly; and, said springs conforming to and contacting said concave inner surfaces and serving as a positive stop against said concave inner surface of said housing.

33. The spring as defined in claim 32, wherein each of said wing tips curves extends convexly outward in a substantially circular arc.

34. The spring as defined in claim 32, wherein each of said wing tips curves extends concavely outward in a substantially circular arc.

35. The spring as in claim 32, wherein said curved wing tips are so curved that when said wing tips are contact against said substantially curved surface they serve as a positive stop against said concave surface.

36. The spring as in claim 32 further comprising at least one through-hole substantially between said distal outer wing tips, wherein said through-hole is suitable to allow passage of a mechanical fastener for securing said spring to a member being held in a friction fit with said concave surface.

37. The spring as in claim 32, wherein a top portion of said spring curves downward to each respective distal end, ending in said respective bent tabs.

38. The spring as in claim 32 wherein said spring is mounted to said collar of said flanged trim opposite to a further spring also mounted to said collar.

* * * * *